US005250110A

United States Patent [19]

Gantert et al.

[11] Patent Number: 5,250,110

[45] Date of Patent: Oct. 5, 1993

[54] DUSTFREE INVESTMENT MATERIAL FOR ACCURATELY FITTING CAST PIECES AND METHOD OF PRODUCING THESE INVESTMENT MATERIALS

[75] Inventors: Gerlinde Gantert, Rodenbach; Bernd Kempf, Freigericht; Klaus-Peter Gundlach, Bohmte; Ulrich Kump, Frankfurt and Main, all of Fed. Rep. of Germany

[73] Assignee: Degussa Aktiengesellschaft, Frankfurt am Main, Fed. Rep. of Germany

[21] Appl. No.: 771,558

[22] Filed: Oct. 7, 1991

[30] Foreign Application Priority Data

Oct. 11, 1990 [DE] Fed. Rep. of Germany ..... 4032254

[51] Int. Cl.[5] ..... B28B 7/34; B22C 1/22; C09B 3/00

[52] U.S. Cl. ..... 106/38.35; 106/35; 106/38.51; 106/38.6; 164/521; 164/527

[58] Field of Search ..... 106/35, 38.2–38.9, 106/38.25; 264/16–20

[56] References Cited

U.S. PATENT DOCUMENTS

| | | | |
|---|---|---|---|
| 2,466,138 | 4/1949 | Wainer | 106/38.9 |
| 2,479,504 | 8/1949 | Moore et al. | 106/38.9 |
| 2,875,073 | 2/1959 | Gogek | 106/38 X |
| 3,074,803 | 1/1963 | McGowan et al. | 106/38.51 |
| 3,081,177 | 3/1963 | Garay et al. | 106/38.51 |
| 4,814,011 | 3/1989 | Kamohara et al. | 106/38.51 |
| 4,909,847 | 3/1990 | Ohi et al. | 106/38.35 |

FOREIGN PATENT DOCUMENTS 3707853 3/1987 Fed. Rep. of Germany .

OTHER PUBLICATIONS

Derwent Publications, Section Ch, Week 8401, Class E17, AN 84-03437 and JP-58 199, 639 (English language abstract), Nov. 1983.

*Primary Examiner*—Mark L. Bell
*Assistant Examiner*—Margaret Einsmann
*Attorney, Agent, or Firm*—Beveridge, DeGrandi, Weilacher & Young

[57] ABSTRACT

Dustfree investment materials, for the production of accurately fitting cast parts, are described which contain water-soluble phosphates, magnesium oxide and silicon dioxide. The investment material is made up of two components (a) and (b) and component (a) contains the entire magnesium oxide, optionally a part of the silicon dioxide and, in the presence of silicon dioxide, 0.4 to 6% by weight of a hydrophile, organic solvent, and component (b) contains the phosphate, the remainder of the silicon dioxide and at least 0.5% by weight water.

33 Claims, No Drawings

DUSTFREE INVESTMENT MATERIAL FOR ACCURATELY FITTING CAST PIECES AND METHOD OF PRODUCING THESE INVESTMENT MATERIALS

BACKGROUND OF THE INVENTION

The present invention relates to a non-dusty investment material compounded with liquids and containing water-soluble phosphates, magnesium oxide and silicon dioxide, for the production of accurately fitting cast parts in dentistry and in the jewelry industry, and to a method of producing such investment materials.

In dentistry and in the jewelry industry, metallic dental prosthesis parts and jewelry parts are generally produced by means of casting methods. To this end, the dental prosthesis part or jewelry part is modeled in wax, embedded, the wax removed by melting, and the molten alloy is then poured into the mold formed in this manner.

High requirements, with respect to the accuracy of the fit of the parts produced from these masses, are placed on the investment materials used for the production of the molds. Thus the contraction of the cast metal part due to the cooling off after the casting must be exactly compensated by the setting expansion and the thermal expansion of the investment material.

Three different types of investment materials are used in dentistry which differ by virtue of the binder system used:

a) Phosphate-bound investment materials;
b) Gypsum-bound investment materials; and
c) Silicate-bound investment materials.

The most widespread are the phosphate-bound investment materials containing magnesium oxide and silicon dioxide since they are highly temperature resistant and can also serve as molds for high-melting burned-on alloys. Phosphate-bound investment materials are stirred with water or a water/silica sol mixture. The addition of the water brings about the setting reaction of the two binder components ammonium phosphate and magnesium oxide.

Silicon dioxide in the form of quartz and its modifications is used as refractory components in all three types of investment materials. In order to obtain a smooth cast surface, the refractory components must also contain very fine particle sizes. Therefore, a development of dust always occurs during the processing (e.g., filling in, weighing, stirring) of the investment materials. The dust which evolves during processing represents a considerable health hazard for the dental technician and the goldsmith. The breathing in of quartz-containing dust can result in silicosis. The respirable fine components of the dust are especially dangerous in this respect.

For this reason, lawmakers have set maximum concentrations of dustiness in the workplace, for example, with the dangerous substances regulation of Apr. 26, 1986 in Germany. The currently valid limit values are about 6 $Mg/M^3$ total dustiness or 4 $mg/M^3$ for quartz-containing fine dust and 0.15 $Mg/M^3$ for respirable, quartz-containing fine dust.

Given the current use of customary investment materials, manufacturers can only remain below these values in a permanent and reliable manner if the work areas are equipped with complicated and expensive suction removal and filter systems.

DE patent 37 07 853 describes a powdery investment material which exhibits only a slight dust formation.

This is achieved in that the powder mixture of soluble phosphate, magnesium oxide and quartz is supplied with 0.5–5% of a wetting agent consisting of liquid, hydrophobic hydrocarbons, fatty acid esters or fatty acids. Since these liquids exhibit a low vapor pressure, they are always relatively long-chain, organic compounds which result in an oily feel in the case of the investment materials and reduce the kneadability, so that anionic, surface-active means must also be added. However, this can negatively alter the technical properties of the investment materials (e.g., low strengths, too high setting expansions, unpleasant odor).

The addition of a liquid to the investment material can also take place for other reasons. Derwent abstract 84-003437/01 describes an investment material to which an aliphatic alcohol is added in amounts of 0.01 to 0.3% by weight in order to prevent the reaction of the binder material on account of the atmospheric humidity and to increase the storage stability therewith. However, the amounts added are so small that no freedom from dust is obtained in this manner.

SUMMARY OF THE INVENTION

An object of the present invention is to provide a non-dusty investment material compounded with liquids and containing water soluble phosphates, magnesium oxide and silicon dioxide for the production of accurately fitting cast parts in dentistry and in the jewelry industry. According to the present invention, the fine dust component is reliably below the legally admissible limiting value without requiring additions which exert a negative influence on the mechanical and thermal properties of the investment material.

A further object of the present invention is to provide a method for producing these investment materials.

DETAILED DESCRIPTION OF THE INVENTION

The present invention achieves this and other objects in that the investment material is prepared from two components; i.e., (a) and (b), of which component (a) contains all the magnesium oxide and component (b) contains all the phosphate, whereas the silicon dioxide constituent is either added only to component (b) or is distributed into the two components (a) and (b). Component (b) contains at least 0.5% by weight water and component a contains, in the presence of silicon dioxide, 0.4% to 6% by weight of a hydrophilic, aliphatic solvent with a vapor pressure less than 600 Pa.

It is preferable if component (a) contains the magnesium oxide, a part of the silicon dioxide and 0.4 to 6% by weight of a monovalent alcohol with 4 to 7 carbon atoms or of a liquid polyvalent alcohol or the corresponding esters.

Instead of the alcohols or their esters, component (a) can also contain hydrophilic carboxylic acids with 3 to 7 C atoms or their esters.

If only magnesium oxide is present in component (a), the organic solvent can be eliminated since magnesium oxide causes less dust and is far less toxic than silicon dioxide.

The two components (a) and (b) can be packed and stored separately in a moist state. They are not brought together in the proper mixing ratio and stirred with the mixing fluid until during the processing.

It is preferable to use a polyvalent alcohol such as ethylene glycol or glycerol as solvent for component (a). Moreover, it can be advantageous to add the entire mixing water necessary for the production of the investment material to component (b). As a result thereof, only components (a) and (b) and no additional mixing water are required to make the investment material ready for use.

It is advantageous if components (a) and/or (b) each contains in addition a water-soluble binder, especially 0.1 to 2% polyvinyl alcohols and/or 0.1 to 5% cellulose derivatives. This allows the powder mixtures to agglomerate; agglomerate diameters of 0.5 to 5 mm have proven to be the best. This agglomeration has the significant advantage that the two components can be remixed subsequently after the drying without a reaction taking place or a charging with dust occurring which exceeds the legal limit value.

The production of the dustfree investment material mass takes place in accordance with the present invention in that component (a), which contains the entire magnesium oxide and, optionally, a part of the silicon dioxide, is compounded in the presence of silicon dioxide with 0.4 to 6% by weight of a hydrophilic, aliphatic solvent with a vapor pressure of less than 600 Pa, and that component (b), which contains the water-soluble phosphate and the remaining part of the silicon dioxide, is compounded with at least 0.5% by weight water.

Monovalent alcohols with 4 to 7 C atoms, liquid polyvalent alcohols or the corresponding esters are used with preference as the hydrophilic, aliphatic solvent.

Components (a) and/or (b) are preferably agglomerated (optionally under the addition of a water-soluble solvent in the form of 0.1 to 2% of a polyvinyl alcohol or of 0.1 to 5% of a cellulose derivative) to agglomerates of preferably 0.5 to 5 mm diameter and subsequently dried. This makes it possible to mix the two components again without a setting reaction being able to take place.

The refractory component silicon dioxide can be divided in principle as desired between the two components (a) and (b). However, it has proven useful to keep the amounts approximately the same size in order to assure as homogeneous a mixing as possible during the stirring.

Tests have shown that a change in dental properties occurs upon the addition of water to component (a); the investment material exhibits a typical ageing effect which is expressed in a distinct diminution of the setting expansions given a rather long storage time. If the water is replaced by a mono- or polyvalent alcohol or an ester, this effect is reduced or entirely avoided. Ageing effects can be reliably avoided if e.g. chemically pure ethylene glycol is used as liquid.

The liquid requirement for maintaining freedom from dust depends to a considerable extent on the range of particle sizes of the materials of the investment material. The finer the material is, the more liquid is needed. Since ethylene glycol entails a diminution of the setting reaction at rather high concentrations, it is logical not to drive up the glycol requirement by too great an amount of sand or by to great a particle fineness. In no case should a glycol content of 5% be exceeded.

Instead of ethylene glycol, butane diol or glycerol can also be used as binding liquid for component a. However, since glycerol is more viscous than glycol, somewhat greater amounts are necessary.

In the case of the (b) component the use of water does not have a negative effect on the dental properties of the investment material. Since the latter is also not dependent on the amount, the water requirement can always be adjusted, conditioned by particle fineness and amount of sand, as is necessary as a supplement to the a component.

The separation of the two components (a) and (b) during the addition of liquid and storage has the consequence that the handling of the dustfree investment material is somewhat more complicated than is the case for the conventional investment materials since a total of three components (2 solid components+mixing liquid) must be processed instead of two components. A certain simplification can be achieved by completely adding the entire mixing fluid at the very beginning to component (b) so that again only two components have to be processed. Such an investment material does not differ in its dental data from the conventional masses. Component (b) is present in this instance as a relatively thin pulp. The refractory component (e.g., $SiO_2$) can contain several parts with different particle sizes (e.g., 1-10 μm, 1-40 μm, 1-80 μm, 1-200 μm, and 60-600 μm). These different particle sizes can separate when the entire mixing fluid (e.g., water, water/silica sol) is added to component (b) and may cause problems when packed in large containers; in order to avoid a separation due to sedimentation, component (b) must be packed in portions.

The handling of the investment material of the present invention can be further improved if the two components are agglomerated separately and mixed together again after the drying.

In order to influence the agglomeration behavior, water-soluble binding agents can also be dissolved in the particular liquid used in the case of both components. The following, for example, have proven to be suitable: Polyvinyl alcohols, tylose, sugar, arabic gum and soluble starch. However, other binding agents customarily used in agglomeration methods are also conceivable in addition. Such binding agents are described e.g. in "Chemical Engineering" (Dec. 4, 1967) which is incorporated by reference in its entirety.

The agglomeration of both components takes place in conventional mixers with a built-up agglomeration occurring on account of an extremely fine spraying of the particular agglomeration liquid. A size of approximately 0.5 to 5 mm is allowed for the agglomerates. The liquid requirement for the desired agglomerate formation is approximately 4 to 60 ml/kg solid for component (a) and approximately 5 to 200 ml/kg for component (b). After the completion of agglomeration, component (b) is dried by being heated to 50° to 1100° C. whereas component (a) can be left in the moist state. The two components can then be mixed together without the storage stability and the dental properties being adversely affected.

If component (a) contains only the magnesium oxide and no silicon dioxide, it can be agglomerated or tabletted without the addition of organic solvents in the form of alcohols, carboxylic acids or esters.

Investment materials agglomerated in this manner are distinguished in comparison to conventional investment materials by distinctly reduced dustiness during processing. In order to measure the dust content by methods known in the art, a specimen of the investment materials in a container was mixed for one minute in an asymmetric mixer. The container was then opened and the dust content immediately measured with a dust measuring device. It was determined that the entire amount of the dust liberated is considerably less than the legally admissible limit values, so that the danger of respirable, quartz-containing dust can be avoided.

EXAMPLES

The table below presents a few examples of the investment materials of the present invention and their properties.

Components (a) and (b) were first homogenized (each time in a dry state in a mixer for three minutes), then the liquid was added under continuous mixing and the mixture remixed for five minutes.

The setting expansion was determined according to DIN (German Industrial Standard) outline 13919, 2nd part. In order to determine the accuracy of fit, schematic crown rings were cast and subsequently optically measured. In order to check the storage stability, repeated measurements were performed after different storage times.

If no significant changes occur during the first four weeks, then storage stability can be expected, according to the previous empirical values, during the customary storage time of one year. The slight changes observed as concerns setting expansion and accuracy of fit after a longer storage time of the investment materials are for the most part within the accuracy of measurement and can be tolerated.

Further variations and modifications of the invention will become apparent to those skilled in the art from the foregoing and are intended to be encompassed by the claims appended hereto.

German Priority Application P 40 32 254.8, filed on Oct. 11, 1990, is relied on and incorporated by reference.

TABLE

| Example | Composition (g) component a | A | component b + | B | Mixing ratio powder to water = 100: | Setting expansion (%) | Slot width (mm) | Storage Stability (after 4 weeks) setting expansion (%) | slot width (mm) |
|---|---|---|---|---|---|---|---|---|---|
| 1 | $SiO_2$ | 86 | $SiO_2$ | 82 | 14–15 | 1.05 | +0.32 | 1.10 | +0.33 |
| | MgO | 14 | $NH_4H_2PO_4$ | 18 | | | | | |
| | ethylene glycol | 1 | water | 4 | | | | | |
| 2 | $SiO_2$ | 88 | $SiO_2$ | 80 | 10–11 | 0.75 | +0.25 | 0.73 | +0.24 |
| | MgO | 14 | $NH_4H_2PO_4$ | 18 | | | | | |
| | ethylene glycol | 0.5 | water | 9 | | | | | |
| 3 | $SiO_2$ | 78 | $SiO_2$ | 90 | 14–15 | 0.85 | +0.28 | 0.84 | +0.26 |
| | MgO | 14 | $NH_4H_2PO_4$ | 18 | | | | | |
| | glycerol | 2 | water | 3 | | | | | |
| 4 | $SiO_2$ | 86 | $SiO_2$ | 82 | 14–15 | 0.95 | +0.30 | 0.93 | +0.29 |
| | MgO | 14 | $NH_4H_2PO_4$ | 18 | | | | | |
| | butane diol | 1 | water | 3 | | | | | |
| 5 | $SiO_2$ | 86 | $SiO_2$ | 82 | 14–15 | 1.00 | +0.33 | 1.02 | +0.34 |
| | MgO | 14 | $NH_4H_2PO_4$ | 18 | | | | | |
| | butyl glycol acetate | 2 | water | 3 | | | | | |
| 6 | $SiO_2$ | 88 | $SiO_2$ | 80 | 15–16 | 0.90 | +0.26 | 0.88 | +0.25 |
| | MgO | 14 | $NH_4H_2PO_4$ | 18 | | | | | |
| | ethylene glycol | 0.5 | arabic gum | 1 | | | | | |
| | | | water | 14 | | | | | |
| 7 | $SiO_2$ | 88 | $SiO_2$ | 80 | 16–17 | 1.10 | +0.34 | 1.15 | +0.35 |
| | MgO | 14 | $NH_4H_2PO_4$ | 14 | | | | | |
| | ethylene glycol | 0.5 | polyvinyl alcohol | 0.3 | | | | | |
| | | | water | 13 | | | | | |
| 8 | $SiO_2$ | 88 | $SiO_2$ | 80 | 16–17 | 1.08 | +0.32 | 1.06 | +0.31 |
| | MgO | 14 | $NH_4H_2PO_4$ | 18 | | | | | |
| | ethylene glycol | 0.5 | tylose | 3 | | | | | |
| | | | water | 14 | | | | | |

What is claimed:

1. A non-dusty investment material, for the production of accurately fitting cast parts for use in the dental industry or in the jewelry industry, compounded with liquids and containing at least one water-soluble phosphate, magnesium oxide and silicon dioxide, said investment material comprising components (a) and (b), wherein said component (a) contains 100% of the magnesium oxide contained in said investment material, said component (b) contains 100% of the water soluble phosphate contained in said investment material, said silicon dioxide is divided between said components (a) and (b), said component (b) contains at least 0.5% by weight water and contains 100% of the water in said investment material, and said component (a) contains 0.4% to 6% by weight of a hydrophilic, aliphatic solvent having a vapor pressure less than 600 Pa.

2. The investment material according to claim 1, wherein said components (a) and (b) each contain approximately equal amounts of silicon dioxide.

3. The investment material according to claim 1, wherein said solvent in said components (2) is selected from the group consisting of monovalent alcohols with 4–7 carbons, liquid polyvalent alcohols, esters of said alcohols, hydrophilic carboxylic acids with 3–7 carbons, esters of said carboxylic acids, and mixtures thereof.

4. The investment material according to claim 3, wherein said solvent is ethylene glycol, butane diol, or glycerol.

5. The investment material according to claim 1, wherein either or both of said component (a) and said component (b) further contain a water-soluble binding agent.

6. The investment material according to claim 5, wherein said binding agent is at least one member selected from the group consisting of 0.1 to 2% polyvinyl alcohol and 0.1 to 5% of a cellulose derivative.

7. The investment material according to claim 5, wherein said binding agent is at least one member selected from the group consisting of polyvinyl alcohols, tylose, sugar, arabic gum, soluble starch, and mixtures thereof.

8. The investment material according to claim 1, wherein said solvent is at least one member of the group consisting of monovalent alcohols, polyvalent alcohols, esters of said alcohols, and mixtures thereof.

9. The investment material according to claim 8, wherein said group consists of butane diol, glycerol, and less than or equal to 5% ethylene glycol.

10. A method of producing a non-dusty investment material for the production of accurately fitting cast parts for use in the dental industry or in the jewelry industry wherein said method comprises mixing component (a) with component (b) to form a mixture, wherein said component (a) contains 100% of the magnesium oxide contained in said investment material, said component (b) contains 100% of the phosphate contained in said investment material, silicon dioxide is divided between said components (a) and (b), and casting said mixture of component (a) and component (b) into a shape, wherein only said component (b) is compounded with water prior to said mixing and wherein said component (a) is compounded with 0.4 to 6% by weight of a hydrophilic, aliphatic solvent with a vapor pressure of less than 600 Pa.

11. The method according to claim 10, wherein said component (a) and (b) contain approximately equal amounts of silicon dioxide.

12. The method according to claim 10, wherein said component (b) is compounded with at least 0.5% by weight water prior to said mixing.

13. The method according to claim 10, wherein said solvent is selected from the group consisting of monovalent alcohols with 4–7 carbons, liquid polyvalent alcohols, esters of said alcohols, hydrophilic carboxylic acids with 3–7 carbons, esters of said carboxylic acids, and mixtures thereof.

14. The method according to claim 13, wherein said solvent is ethylene glycol, butane diol, or glycerol.

15. The method according to claim 10, further comprising agglomerating said components (a) and (b) separately.

16. The method according to claim 15, wherein said agglomerates are 0.5 to 5 mm in diameter.

17. The method according to claim 15, wherein said agglomerating occurs in the presence of a water soluble binding agent.

18. The method according to claim 17, wherein approximately 4 to 60 ml of said water soluble binding agent is added per kg of said component (a), or approximately 5 to 200 ml of said water soluble binding agent is added per kg of said component (b) or approximately 4 to 60 ml of said water soluble binding agent is added per kg of said component (a) and approximately 5 to 200 ml of said water soluble binding agent is added per kg of said component (b).

19. The method according to claim 17, wherein said water soluble binding agent is 0.1 to 2% polyvinyl alcohol or 0.1 to 5% of a cellulose derivative.

20. The method according to claim 17, wherein said water soluble binding agent is at least one member selected from the group consisting of polyvinyl alcohol, tylose, sugar, arabic gum, soluble starch, and mixtures thereof.

21. The method according to claim 15, further comprising drying said agglomerated component (a) or (b) or (a) and (b).

22. The method according to claim 21, wherein said components (a) and (b) are agglomerated separately prior to said drying and said agglomerated components (a) and (b) are mixed together after said drying.

23. The method according to claim 21, wherein said agglomerated component (b) is dried at 50° to 110° C.

24. The method according to claim 21, wherein said agglomerated component (a) is not dried.

25. A three component package for the production of a non-dusty investment material utilized in the production of accurately fitting cast parts for use in the dental industry or in the jewelry industry, said package comprising components (a), (b), and (c), wherein said component (a) contains 100% of the magnesium oxide necessary for the production of said investment material, said component (b) contains 100% of the water soluble phosphate necessary for the production of said investment material, silicon dioxide is divided between said components (a) and (b), said component (c) contains mixing liquid, and said component (a) contains 0.4% to 6% by weight of a hydrophilic, aliphatic solvent having vapor pressure less than 600 Pa.

26. The three component package according to claim 25, wherein said component (b) contains at least 0.5% by weight of water.

27. A two component package for the production of a non-dusty investment material utilized in the production of accurately fitting cast parts for use in the dental industry or in the jewelry industry, said package comprising components (a) and (b), wherein said component (a) contains 100% of the magnesium oxide necessary for the production of said investment material, said component (b) contains 100% of the water soluble phosphate necessary for the production of said investment material, silicon dioxide is divided between said components (a) and (b), said component (b) contains at least 0.5% by weight water, and said component (a) contains 0.4% to 6% by weight of a hydrophilic, aliphatic solvent having a vapor pressure less than 600 Pa.

28. The two components package according to claim 27, wherein said component (b) contains all the water necessary for the production of said investment material.

29. A non-dusty investment material, for the production of accurately fitting cast parts for use in the dental industry or in the jewelry industry, produced by the method according to claim 10.

30. The investment material according to claim 1, wherein said component (a) consists essentially of magnesium oxide, silica, and a hydrophilic aliphatic solvent having a vapor pressure less than 600 Pa.

31. The method according to claim 10, wherein said component (a) consists essentially of magnesium oxide, silica, and a hydrophilic aliphatic solvent having a vapor pressure less than 600 Pa.

32. The three component package according to claim 25, wherein said component (a) consists essentially of magnesium oxide, silica, and a hydrophilic aliphatic solvent having a vapor pressure less than 600 Pa.

33. The two component package according to claim 27, wherein said component (a) consists essentially of magnesium oxide, silica, and a hydrophilic aliphatic solvent having a vapor pressure less than 600 Pa.

* * * * *